US012662830B2

(12) United States Patent
Hatfield et al.

(10) Patent No.: US 12,662,830 B2
(45) Date of Patent: Jun. 23, 2026

(54) INJECTION MOLDING STITCHING FOR STRUCTURAL REINFORCEMENT

(71) Applicant: INTERNATIONAL BUSINESS MACHINES CORPORATION, Armonk, NY (US)

(72) Inventors: Jennifer M. Hatfield, Portland, OR (US); Sarbajit Kumar Rakshit, Kolkata (IN); Carolina Garcia Delgado, Zapopan (MX); Randy A. Rendahl, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 18/907,761

(22) Filed: Oct. 7, 2024

(65) Prior Publication Data

US 2026/0098415 A1 Apr. 9, 2026

(51) Int. Cl.
*E04G 23/02* (2006.01)

(52) U.S. Cl.
CPC ..... *E04G 23/0211* (2013.01)

(58) Field of Classification Search
CPC ..... E04G 23/0211
See application file for complete search history.

(56) References Cited

U.S. PATENT DOCUMENTS 5,771,557 A * 6/1998 Contrasto ..... E04G 23/0218 29/402.11
6,206,674 B1 3/2001 Foltuz et al.
6,532,714 B1 * 3/2003 Ferm ..... E04G 23/0218 404/75
7,959,844 B1 6/2011 Sahm, III et al.
8,688,415 B2 4/2014 Holdbrook
10,494,826 B1 * 12/2019 Wheatley ..... E04G 23/0229
2005/0204673 A1 * 9/2005 Reed ..... E04G 23/0229 52/514
2006/0010826 A1 * 1/2006 Canteri ..... E04G 23/0203 52/741.4
2007/0050963 A1 * 3/2007 Keller ..... E04G 23/0218 29/402.06

(Continued)

FOREIGN PATENT DOCUMENTS

WO 00/38899 A1 7/2000

OTHER PUBLICATIONS

AutomateUK, Benefits of robots in manufacturing: Why use robots?, Screenshot taken on Feb. 23, 2024, available at https://www.automate-uk.com/our-associations/bara/expert-advice/robots-explained/benefits-of-robots-in-manufacturing/ (Year: 2024).*

(Continued)

*Primary Examiner* — Kyle A Cook
(74) *Attorney, Agent, or Firm* — CHIP LAW GROUP

(57) ABSTRACT

A computer-implemented method for repairing a structural defect includes determining a size and position of a defect within a structural element and, in accordance with a structural analysis of the defect, determining a stitching pattern that counters loss of structural integrity due to the defect. A set of holes and channels are formed in the structural element in accordance with the stitching pattern. The set of holes and channels in the structural element are filled around the defect in accordance with the stitching pattern to increase strength around the defect.

14 Claims, 7 Drawing Sheets

(56) References Cited

U.S. PATENT DOCUMENTS

| | | | | |
|---|---|---|---|---|
| 2009/0078843 | A1* | 3/2009 | Trotter | E04G 21/32 248/354.1 |
| 2015/0068154 | A1* | 3/2015 | Merlob | E04B 1/41 52/741.1 |
| 2018/0251990 | A1* | 9/2018 | Sasaki | B05C 21/00 |
| 2019/0010719 | A1* | 1/2019 | Secrest | E04G 23/0288 |
| 2020/0208421 | A1* | 7/2020 | Weise | E04G 23/0203 |
| 2022/0025191 | A1* | 1/2022 | Rakshit | H01F 1/44 |
| 2024/0024914 | A1* | 1/2024 | Beck | B05C 17/005 |

OTHER PUBLICATIONS

SyBridge Technologies, (Jan. 18, 2024), "7 Common Injection Molding Defects and How to Avoid Them", https://sybridge.com/injection-molding-defects/, pp. 1-7.

Stringer et al., (Oct. 2008), "Assesment and Rehabilitation Methods for Longitudinal Cracks and Joint Separations in Concrete Pavement", Center for Transportation Research, pp. 1-319.

Data Spree, (Jun. 2022), "Better Injection Molding Processes With AI Plastic Inspection", https://www.data-spree.com/blog/better-injection-molding-processes-with-ai-plastic-inspection, pp. 1-3.

Araki et al., (Feb. 2011), "Brick Wall Strengthened With Epoxy Resin Injection Method", AIJ J. Technol. Des. vol. 17, No. 35, pp. 177-182.

Magnifico, (Mar. 2023), "How AI Can Be Used to Advance Injection Molding", https://www.linkedin.com/pulse/how-ai-can-used-advance-injection-molding-matthew-magnifico#:~:text=For%20example%2C%20an%20AI%20system,the%20consistency%20of%20their%20products., pp. 1-4.

Giordano, (Jun. 2022), "How Artificial Intelligence is Transforming Injection Molding", Plastics Today, pp. 1-5.

A Study Of Structural Analysis in Stress Engineering, Retrieved from: https://web.archive.org/web/20201202083853/https://www.imaginationeering.com/a-study-of-structural-analysis-in-stress-engineering/, Nov. 6, 2020, 11 pages.

Chen, et al., Repair of Longitudinal Joints and Cracks, New Technologies in Construction and Rehabilitation of Portland Cement Concrete Pavement and Bridge Deck Pavement, Apr 26, 2012.

Marketsandmarket, 3D Printing Market Size, Share, Industry Analysis Repot 2030, Retrieved from: https://www.marketsandmarkets.com/Market-Reports/3d-printing-market-1276.html, Apr. 2024, 29 pages.

What is Structural Analysis? Strength of Materials, Retrieved from: https://www.brighthubengineering.com/structural-engineering/44070-basics-of-structural-analysis/, Retrieved date: May 20, 2025, 5 pages.

Wikipedia, Injection Moulding, Retrieved from: https://en.wikipedia.org/wiki/Injection_moulding, Retrieved date: May 20, 2025, 18 pages.

Wikipedia, Structural Analysis, Retrieved from: https://en.wikipedia.org/wiki/Structural_analysis, Retrieved date: May 20, 2025, 9 pages.

* cited by examiner

INJECTION MOLDING STITCHING FOR STRUCTURAL REINFORCEMENT

BACKGROUND

The present invention generally relates to structural reinforcement, more particularly, systems and methods that reinforce defects in structures.

Structural cracks in a building or other structure typically occur due to stress, shifting, settling, or other issues that affect stability. These cracks can occur in various parts of a structure, such as walls, floors, ceilings, beams, columns or foundations. In any structure, cracking can occur over a period of a time. The crack can propagate and possibly weaken the structure.

SUMMARY

In accordance with an embodiment of the present invention, a computer-implemented method for repairing a structural defect includes determining a size and position of a defect within a structural element and, in accordance with a structural analysis of the defect, determining a stitching pattern that counters loss of structural integrity due to the defect. A set of holes and channels are formed in the structural element in accordance with the stitching pattern. The set of holes and channels in the structural element are filled around the defect in accordance with the stitching pattern to increase strength around the defect.

In accordance with another embodiment of the present invention, a system for repairing a structural defect includes a hardware processor; and a memory that stores a computer program which, when executed by the hardware processor, causes the hardware processor to determine a size and position of a defect within a structural element; in accordance with a structural analysis of the defect, determine a stitching pattern that counters loss of structural integrity due to the defect; form, with a computer controlled milling tool, a set of holes and channels in the structural element in accordance with the stitching pattern; and fill, with a computer controlled filling tool, the set of holes and channels in the structural element around the defect in accordance with the stitching pattern to increase strength around the defect.

In accordance with another embodiment of the present invention, a structural element includes a stitching pattern disposed about a defect within the structural element, the stitching pattern including: a plurality of stitches that extend between regions of non-defective material and across a region of the defect. The plurality of stitches includes an injected material and is connected in a geometric pattern such that the geometric pattern counters loss of structural integrity due to the defect.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Figure 1:
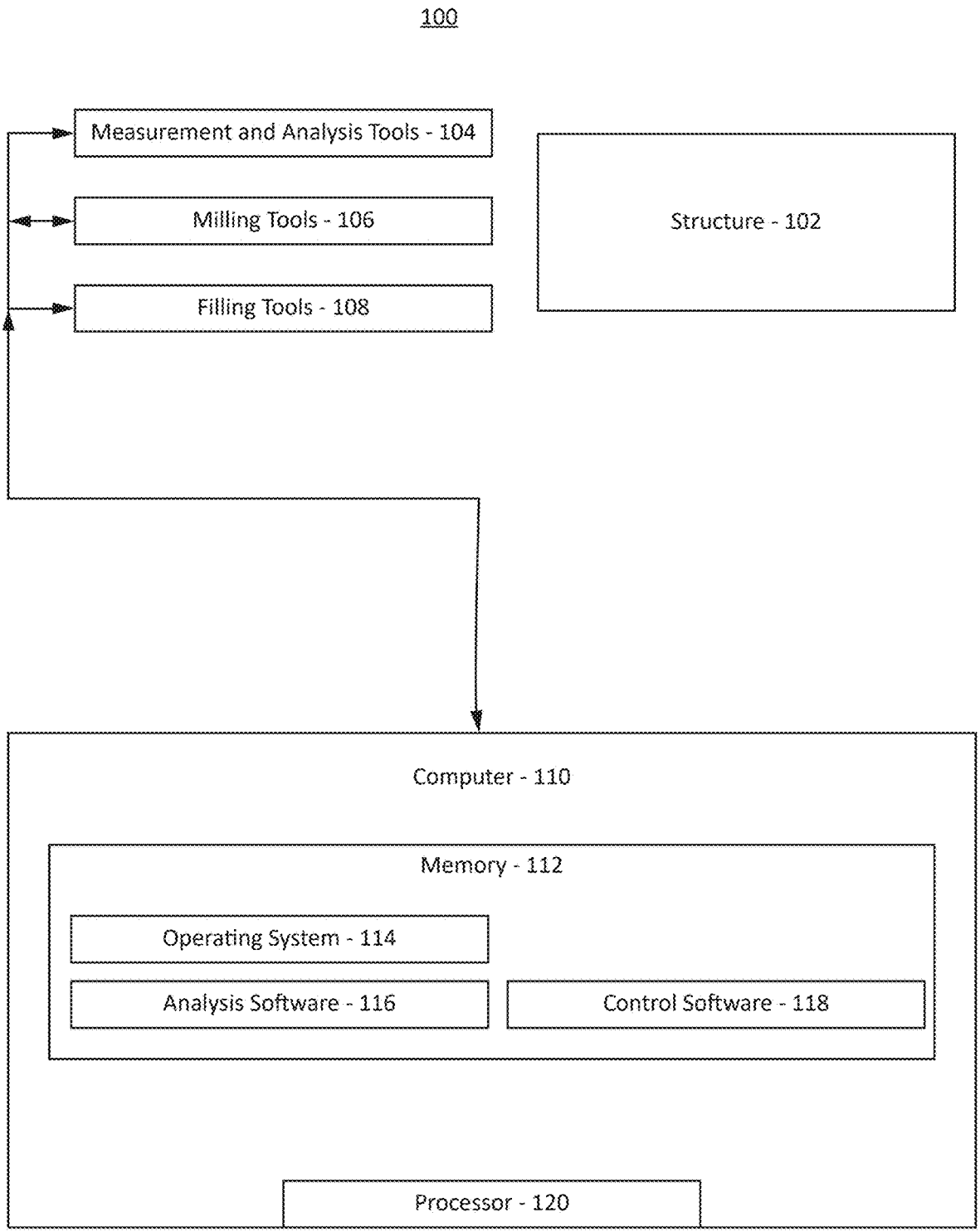
FIG. 1 is a block diagram of a system for a stitching repair for structural reinforcement, in accordance with an embodiment of the present invention.

In accordance with embodiments of the present invention, systems and methods for structural crack repairs are described. In an embodiment, a system identifies a location and size of a crack. Material is removed around the crack by opening up holes and passages around the crack. The holes and passages are filled with a supporting material. The supporting material can include a three dimensional (3D) printed material or an injection molded material to introduce material into the holes and passages. The supporting material can be selected based on injectability, strength, etc., once cured or set up within the holes and passages. The holes and passages are oriented to draw stress away from the crack and provide the ability to endure the working loads for which the structure was designed.

In an embodiment, 3D printing can be combined with casting or other fabrication processes to provide the opportunity to accelerate print jobs that have highly variable levels of detail ranging from fine grained printing requiring a fine printer nozzle to large block fill items that need a volume filled rapidly. By providing dual processing, the highly detailed areas can be built up using the 3D print nozzle while the volume can be filled in parallel by a casting model. For example, a deep channel in the structural can be filled by a first process and a surface can be filled by a second process, where aesthetics can be more important.

Based on detection of one or more defective portions inside any structure (e.g., an internal crack which is not visible from the outside), systems in accordance with embodiments of the present invention can analyze structural properties (e.g., thickness of the structure, material properties of the structure, magnitude of defective portions, etc.), and based on the relative position of a detected internal crack, the system can select appropriate relative locations around the structure where reinforcement can be performed with appropriate types of manufacturing processes.

A set of holes and/or channels are formed around the defective portions (e.g., using a laser beam or any machining methods), so that a stitching pattern can be created to provide reinforcement of the structure. The set of holes and/or channels are filled with a material to form stitching around the defective portions to gain needed strength around the defective portion, and to prevent further propagation of the defective portion. The stitching pattern when filled forms a cage-like structure within the structure to provide support for the defective portion.

The load on the applied crack can be determined using stress analysis and/or stress measurement tools. The identified structural material, pattern of internal crack on the structure, portion of the structure above the internal crack, etc. can be employed to estimate a load applied on the crack, and estimate how much counter force is needed for reinforcement. Based on the needed reinforcement strength on the structure, the dimensions of the internal crack, a distribution of a reinforcement force on the structure is determined and employed to define a set of holes and/or channels that are to be created for stitching. Artificial intelligence tools or other analysis tools (e.g., finite element tools) can be employed to assist in determining the stitching pattern.

Considering the material that will be employed for stitching-based reinforcement, an amount of reinforcement force to be created and dimensions of the stitching, the system in accordance with embodiments of the present invention computes a diameter of the thread that is to be used for stitching and provides reinforcement. Once the holes and/or channels and associated spaces are created to accommodate the thread on the structure, the system uses appropriate manufacturing methods, such as, e.g., injection molding, 3D printing, etc., to create the thread to stitch the defective portion and provide reinforcement.

Referring now to the drawings in which like-numerals represent the same or similar elements and initially to FIG. 1, a structural reinforcement system 100 is shown in accordance with an embodiment of the present invention. The system 100 includes components to analyze a structure 102 and provide reinforcement for any discovered defects. The structure 102 can include any structural element, such as a cut stone, a brick, a beam, a column, a footing or any other load-bearing structure employed in construction or other industry. The structure 102 can be checked for defects, such as cracks, by measurement and analysis tools 104. Measurement and analysis tools 104 can include X-ray, ultrasound, infrared, eddy current analysis or other energy beams or penetrating energy sources used for checking the consistency of material. For example, if radiation is reflected due to an inconsistency in the material, a defect is likely the cause. If a defect is discovered, the measurement and analysis tools 104 can also evaluate its size, its location and its type. A defect can be repaired within an operating structure or the structure can be removed and repaired. In some embodiments, structural elements can be tested, after manufacture, and repaired before being used.

Structural cracks are a concern because they can compromise the integrity and safety of a building or other structure. Cracks may indicate other underlying problems, such as excessive loads, inadequate design, poor construction, foundation movement, or latent damage from, e.g., natural disasters like earthquakes, etc. Different types of structural cracks include vertical cracks, horizontal cracks, diagonal cracks, stair-step cracks, settlement cracks, etc. Vertical cracks run straight up and down and are often caused by settling or shrinkage of materials. Horizontal cracks are usually more serious than vertical cracks and may indicate structural movement or pressure from the surrounding soil. Diagonal cracks run diagonally across walls or other structural elements and can be a sign of structural movement or stress. Stair-step cracks resemble a series of steps and are commonly seen in masonry or concrete block walls, indicating movement or settling. Settlement cracks occur when a foundation settles unevenly, leading to differential movement and cracks in the structure.

The measurement and analysis tools 104 assesses structural cracks or other defects. In an embodiment, a hardness of the structure 102 can also be evaluated to determine if a repair can be performed. The measurement and analysis tools 104 can employ analysis software 116 stored in a memory 112 of a computer device 110. The computer device 110 includes an operating system 114 and a hardware processor 120 for carrying out structural analyses and controlling the tools or the system 100, e.g., software tools with sensor inputs.

The analysis software 116 can include modeling of the structure 102 by employing information on its material, age and dimensions. The analysis software 116 can be employed to determine how much counter reinforcement strength is needed and determine the configuration of the reinforcement structure (e.g., stitching pattern). Once the defect and its counter measures are evaluated and a repair is deemed possible, milling tools 106 are activated.

Milling tools 106 can include a laser milling machine, a mechanical milling machine, drills including a routing drill that can remove material in different directions. Based on the analysis of the measurement and analysis tools 104 and the analysis software 116, a stitching pattern and thread diameter of the stitching pattern are determined. Since the size and location of the defect are known from the analysis, a stitching pattern including a number of stitches, their angle relative to each portion of the pattern and the thickness of the thread along with other features of the stitching pattern can be determined to provide appropriate reinforcement to the defect.

For example, in an embodiment, a determination that three stitches will be needed on two lateral sides of the defect. The stitches will extend 3 inches above (into non-defective material) and three inches below (into non-defective material) the defect on both sides, and the thread diameter with be 2 inches. Other features and orientations are also contemplated and can include surface reinforcement, longitudinal (along the crack) reinforcement, etc.

The milling tools 106 can be controlled by control software 118 to guide the laser or drill bits to make holes and channels to form the determined stitch pattern. In some embodiments, where the structure 102 is supporting a load, a temporary load support structure can be employed during the milling of the stitching pattern.

After the stitching pattern is milled into the structure 102, filling tools 108 are employed to fill the stitching pattern to provide reinforcement of the defect by manufacturing side structures to provide structural support for the defect. In an embodiment, the filling tools 108 can include an injection molding machine. The injection molding machine can include a nozzle that applies molten material under pressure into the stitching pattern. When the molten material solidifies in the holes/channels of the stitching pattern, reinforcement of the defect is provided.

Injection molding can be performed with a host of materials including metals (for which the process is called die-casting), glasses, elastomers, thermoplastics and thermosetting polymers. Material is fed into a heated barrel, mixed (using a helical screw), and injected into the stitching pattern cavity, where it cools and hardens to the configuration of the stitching pattern.

In another embodiment, the filling tools 108 can include a 3D printing device. A print head of the 3D printing device is introduced into the hole/channels of the stitching pattern and deposits printing filament materials along the stitching pattern. 3D printing technology can employ photopolymers. In some embodiments, 3D printing and injection molding can be employed together. For example, some photopolymers do not melt during injection molding and can be used with injection molding. Combinations of filling tools 108 can also be employed. For example, filling tool 108 can include a printed portion of the stitching pattern and an injection molded portion of the stitching pattern. Such determinations can be made based on the diameter of the thread, the materials available for each filling method, etc.

When complete, the printed stitching pattern provides reinforcement of the defect. Other filling tools 108 can also be employed.

Figure 2:
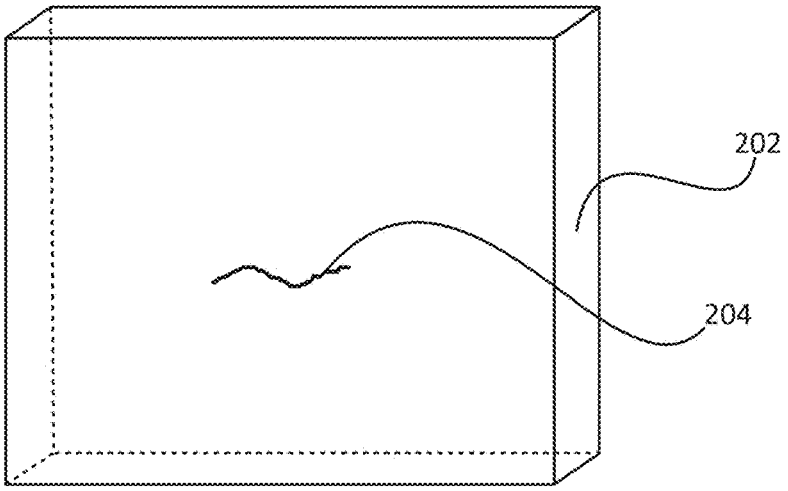
FIG. 2 is a schematic diagram showing a defect in a structural element (slab), in accordance with an embodiment of the present invention.

Referring to FIG. 2, a slab structure 202 can include cut stone, concrete or any other structural materials. The slab structure 202 includes a crack 204 disposed internally along the center of the slab structure 202. The crack 204 is horizontal and therefore is likely to cause concerns if the crack grows further. The crack may be discovered using measurement and analysis tools 104 as described with reference to FIG. 1.

Based on image analysis or other analyses, any internal crack, its dimensions, its location and its features are identified. The internal crack 204 can be a structural discontinuity that can reduce the structural strength. This can include structural stress analysis at different points. Based on a relative position of the crack 204 within the slab structure 202 a feasible stitching patterning can be identified based on location within the slab structure 202. Based on the types of structural vulnerabilities, like major damage in the structure, minor damage in the structure, and the predefined safety norms, whether the internal crack 204 can be addressed with reinforcement stitching can be determined and where reinforcement is needed, if a repair is feasible.

Based on the position of the internal crack 204, and by leveraging structural analysis, an evaluation of the slab structure and its suitability for a repair is completed.

Figure 3:
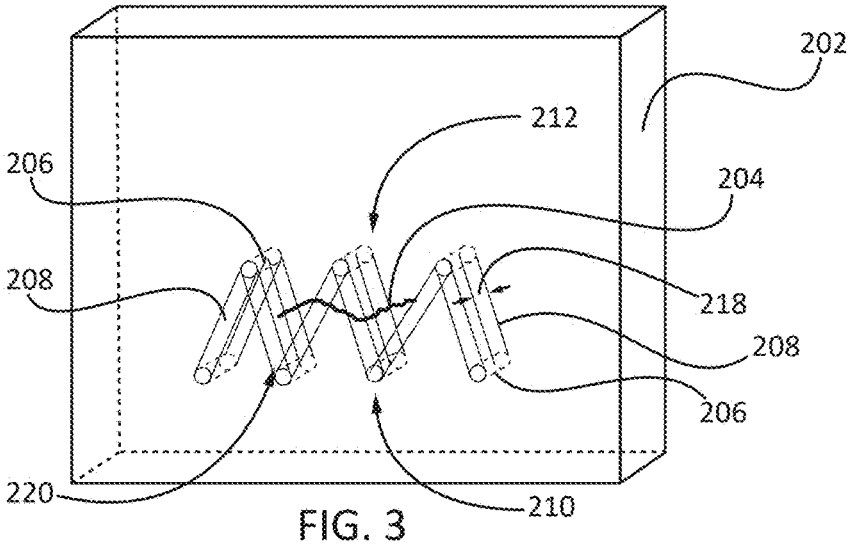
FIG. 3 is a schematic diagram showing a stitching pattern formed in the slab, in accordance with an embodiment of the present invention.

Referring to FIG. 3, after detecting the structural internal crack 204, and based on detected structural vulnerabilities, a reduction in structural strength is determined to identify how much counter reinforcement strength is to be created.

Counter reinforcement strength can be evaluated by designing a stitching pattern 220. The stitching pattern 220 provides how the reinforcement strength is to be spread along the length of the crack 204, and then with one or more matching methods through holes 206 can be created by drilling through the slab structure 202. The through holes 206 can then be connected using an angled drill bit or a laser to connect the through holes 206 with channels 208. Here, a determination was made that the stitching pattern 220 could be formed on opposing sides 210 and 212 of the crack 204 to provide a symmetrical counter reinforcement structure. Also, a thread diameter 218 of the channels 208 and through holes 206 is determined and implemented. The thread diameter 218 has an impact on the strength provided as well as the ease of filling the stitching pattern 220. The stitching pattern 220 with through holes 206 and channels 208 may be milled using milling tools 106 as described with reference to FIG. 1. In some embodiments, multiple thread diameters or thicknesses can be employed.

Figure 4:
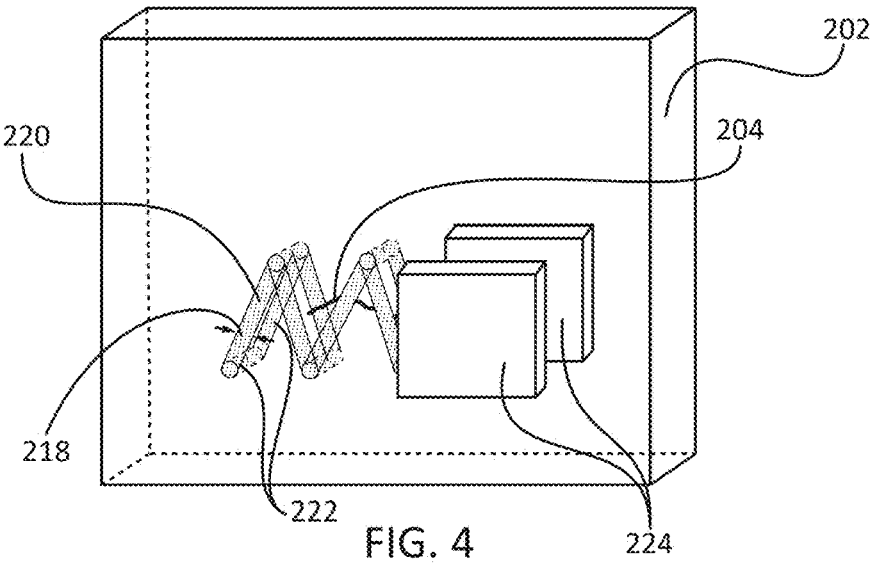
FIG. 4 is a schematic diagram showing the stitching pattern filled to reinforce the slab about the defect, in accordance with an embodiment of the present invention.

Referring to FIG. 4, the stitching pattern 220 is filled with reinforcing materials. The materials can include a liquid form or be deposited using an additive manufacturing method, such as, e.g., 3D printing. A plurality of stitches of the stitching pattern can extend between regions of non-defective material and across a region of the defect to effectively bypass the weakened defective structure. The stitching pattern can include any number of stitches in any number of patterns or any number of different orientations. Stitches can be horizontal, vertical or at any angle in between. The stitching pattern 220 can include zigzag, stitches, parallel stitches, angled stitched or any other pattern.

In an embodiment, an injection molding device 224 is set up on sides of the slab structure 202 so that liquid material can be introduced into the stitching pattern 220. The stitching pattern 220 can be prepared by blocking off openings of the though holes to reduce loss of the liquid during injection. Upon cooling or curing of the liquid, a reinforcement structure 222 is achieved which can support some of the load and prevent crack propagation.

Figure 5:
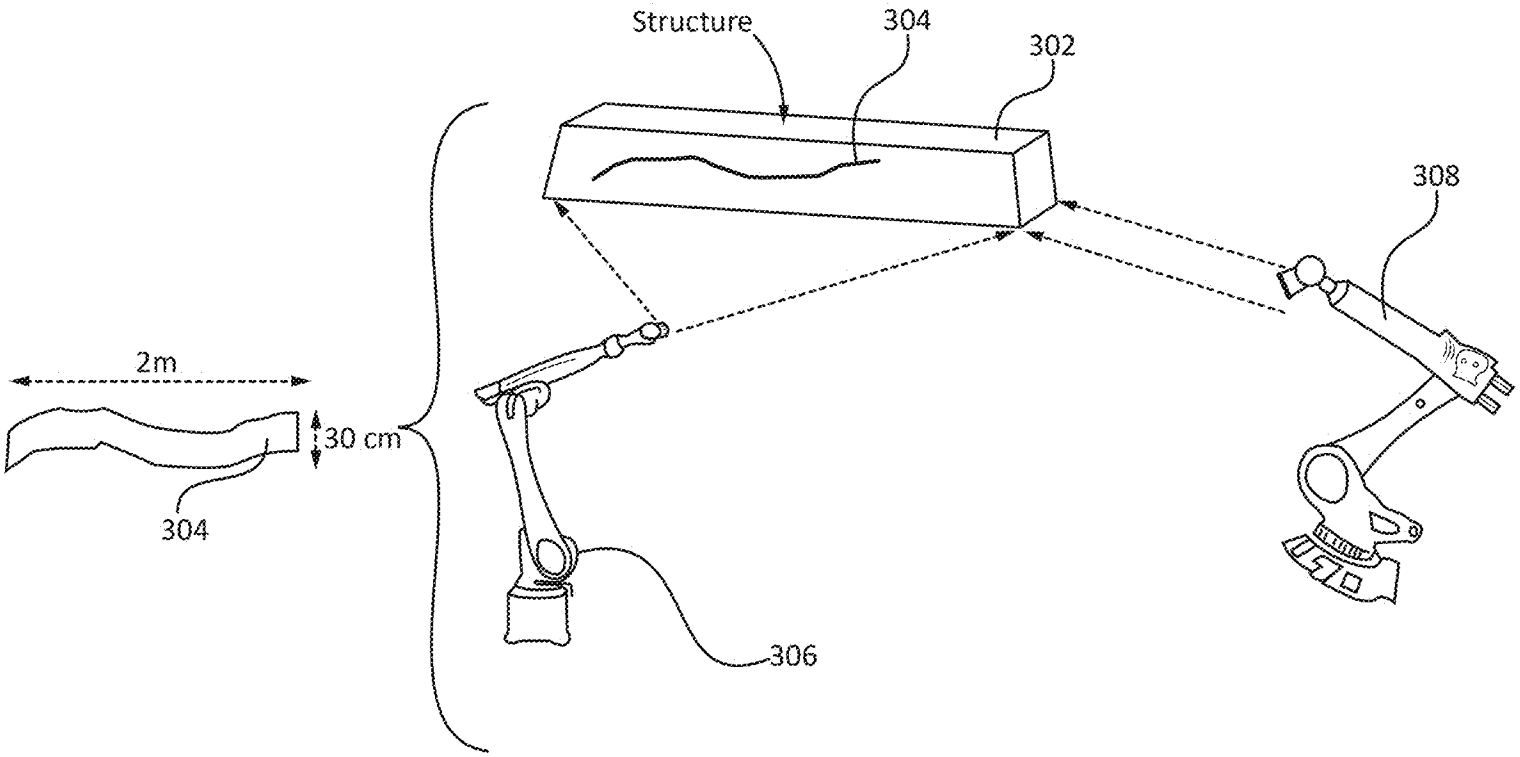
FIG. 5 is a schematic diagram showing a robot scanning a structural element, in accordance with an embodiment of the present invention.

Referring to FIG. 5, measurement and analysis tools 104 can include one or more robots 306 and 308 to analyze a structure 302, e.g., a beam element. The robots 306 and 308 can include scanning robots equipped with scanning devices such as, e.g., an x-ray source and detector, a laser and detector, an infrared source and detector, etc. The robot 306 can scan a length of the structure 302 while the robot 308 can scan a width of the structure 302 to determine any defects within the structures 302. In an embodiment, the robots 306 and 308 can include 3D/4D printing robots that can employ control software 118, FIG. 1 to control scanning motions.

The scanning of the robots 306 and 308 identify a position and size (e.g., 2 meters long by 30 cm in height) of a crack 304. The position and size of the crack 304 along with the material of the structure 302 and other features can be employed to determine the counter reinforcement and stitching pattern needed to repair the crack 304, if a repair is feasible.

Figure 6:
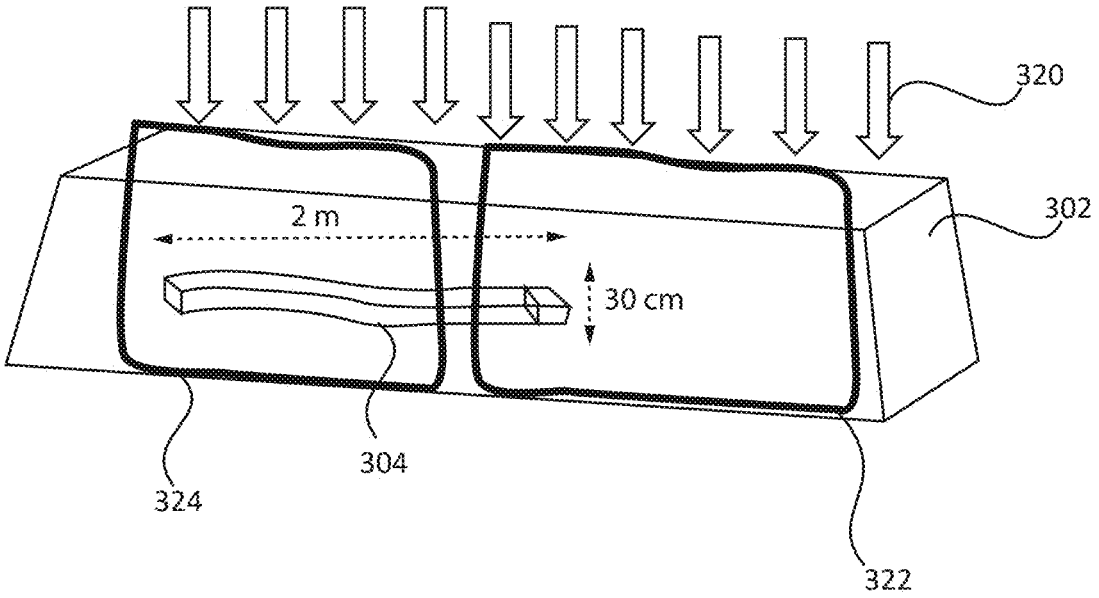
FIG. 6 is a schematic diagram showing a structural element loaded as part of a structural analysis, in accordance with an embodiment of the present invention.

Referring to FIG. 6, loading 320 of the structure 302 is considered in the analysis for the reinforcement repair. In an embodiment, a structural stress analysis includes material properties, loading 320 and dimensions of the structure 302, among other things. Structural analysis can employ finite element analysis or other computer aided design programs to determine the structural stresses on the crack 304. The finite element analysis or other analysis can also include counter forces or counter stresses provided by introduced structures and materials of the stitching pattern used in the repair. The finite element analysis or other analysis can permit adding different configurations, thread diameters, geometries and material properties to define a stitching pattern that best suits the repair.

The material used in the structure 302 to repair the crack 304 can be selected using the finite element analysis or other analysis by considering compressive and tensile strengths of the material used in the structure and the stitching pattern. Based on the structural strength, (based on structural analysis), a magnitude and placement of counterforces to be applied with a reinforcement stitching pattern can be determined. A weak portion 324 under current loads 320 will need a stitching pattern to counter the reduced structural integrity as a result of the crack 304, while a stronger portion 322 may not need any stitching pattern.

Figure 7:
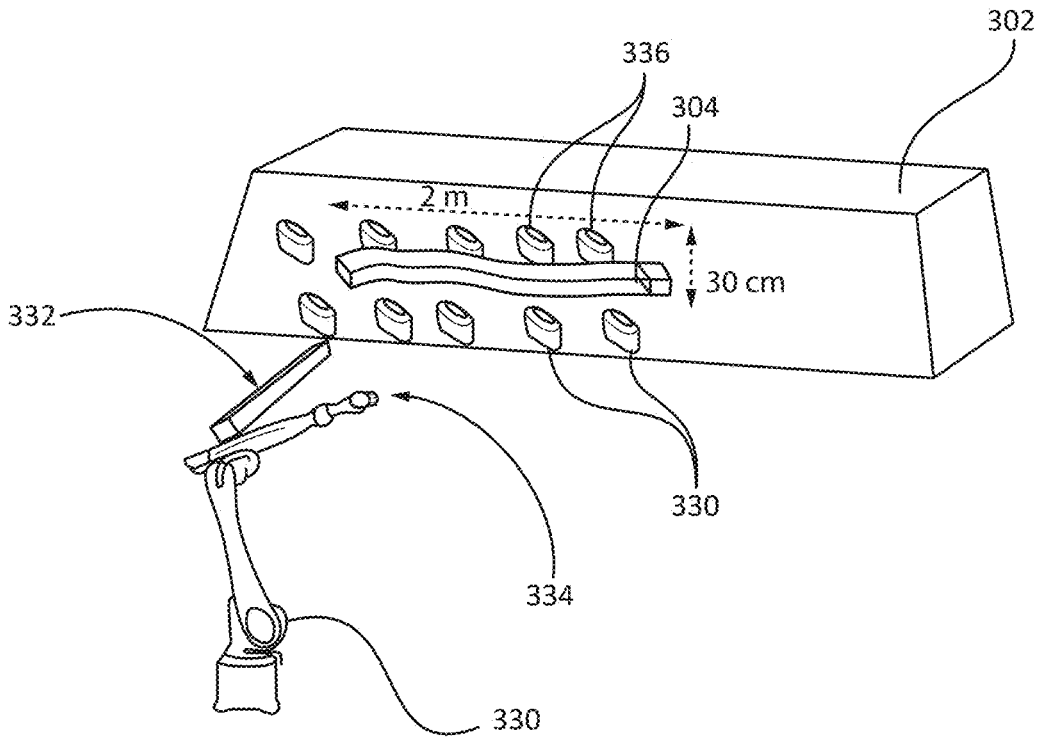
FIG. 7 is a schematic diagram showing a structural element milled and filled by a 3D printing robot, in accordance with an embodiment of the present invention.

Referring to FIG. 7, using the dimension of the crack 304, structural design norms, and the structural analysis, the size, shape (appropriate proportions) and material of the stitching pattern is determined. The stitching pattern provides the needed strength to provide support to the structure 302. Based on the needed counter force, the stitching pattern is designed. In the event that a sufficiently reinforcing design cannot be found, additional materials or stitching pattern shapes for different fit and function can be considered as alternatives as well as considerations in function, cost and availability.

With a stitch design and material defined, a repair can be made to the structure 302 to match specifications. A 3D/4D printing robot 330 can be equipped with milling tools 332, e.g., a drill or a laser. The robot 330 employs the milling tool 332 to create openings around the crack 304, and channels around the holes. Once the holes and associated channels are created, then the robot 330 can employ a filling tool 334, such as a print head or injection molding fixture or any mode of 3D printing to fill the through holes and the channels with a different material 336 than the structure 302. Once the through holes and the associated channels are filled with the material and solidified, then the structural portion is reinforced with stitching in accordance with a stitched pattern configuration.

Various aspects of the present disclosure are described by narrative text, flowcharts, block diagrams of computer systems and/or block diagrams of the machine logic included in computer program product (CPP) embodiments. With respect to any flowcharts, depending upon the technology involved, the operations can be performed in a different order than what is shown in a given flowchart. For example, again depending upon the technology involved, two operations shown in successive flowchart blocks may be performed in reverse order, as a single integrated step, concurrently, or in a manner at least partially overlapping in time.

A computer program product embodiment ("CPP embodiment" or "CPP") is a term used in the present disclosure to describe any set of one, or more, storage media (also called "mediums") collectively included in a set of one, or more, storage devices that collectively include machine readable code corresponding to instructions and/or data for performing computer operations specified in a given CPP claim. A "storage device" is any tangible device that can retain and store instructions for use by a computer processor. Without limitation, the computer readable storage medium may be an electronic storage medium, a magnetic storage medium, an optical storage medium, an electromagnetic storage medium, a semiconductor storage medium, a mechanical storage medium, or any suitable combination of the foregoing. Some known types of storage devices that include these mediums include diskette, hard disk, random access memory (RAM), read-only memory (ROM), erasable programmable read-only memory (EPROM or Flash memory), static random access memory (SRAM), compact disc read-only memory (CD-ROM), digital versatile disk (DVD), memory stick, floppy disk, mechanically encoded device (such as punch cards or pits/lands formed in a major surface of a disc) or any suitable combination of the foregoing.

A computer readable storage medium, as that term is used in the present disclosure, is not to be construed as storage in the form of transitory signals per se, such as radio waves or other freely propagating electromagnetic waves, electromagnetic waves propagating through a waveguide, light pulses passing through a fiber optic cable, electrical signals communicated through a wire, and/or other transmission media. As will be understood by those of skill in the art, data is typically moved at some occasional points in time during normal operations of a storage device, such as during access, de-fragmentation or garbage collection, but this does not render the storage device as transitory because the data is not transitory while it is stored.

Figure 8:
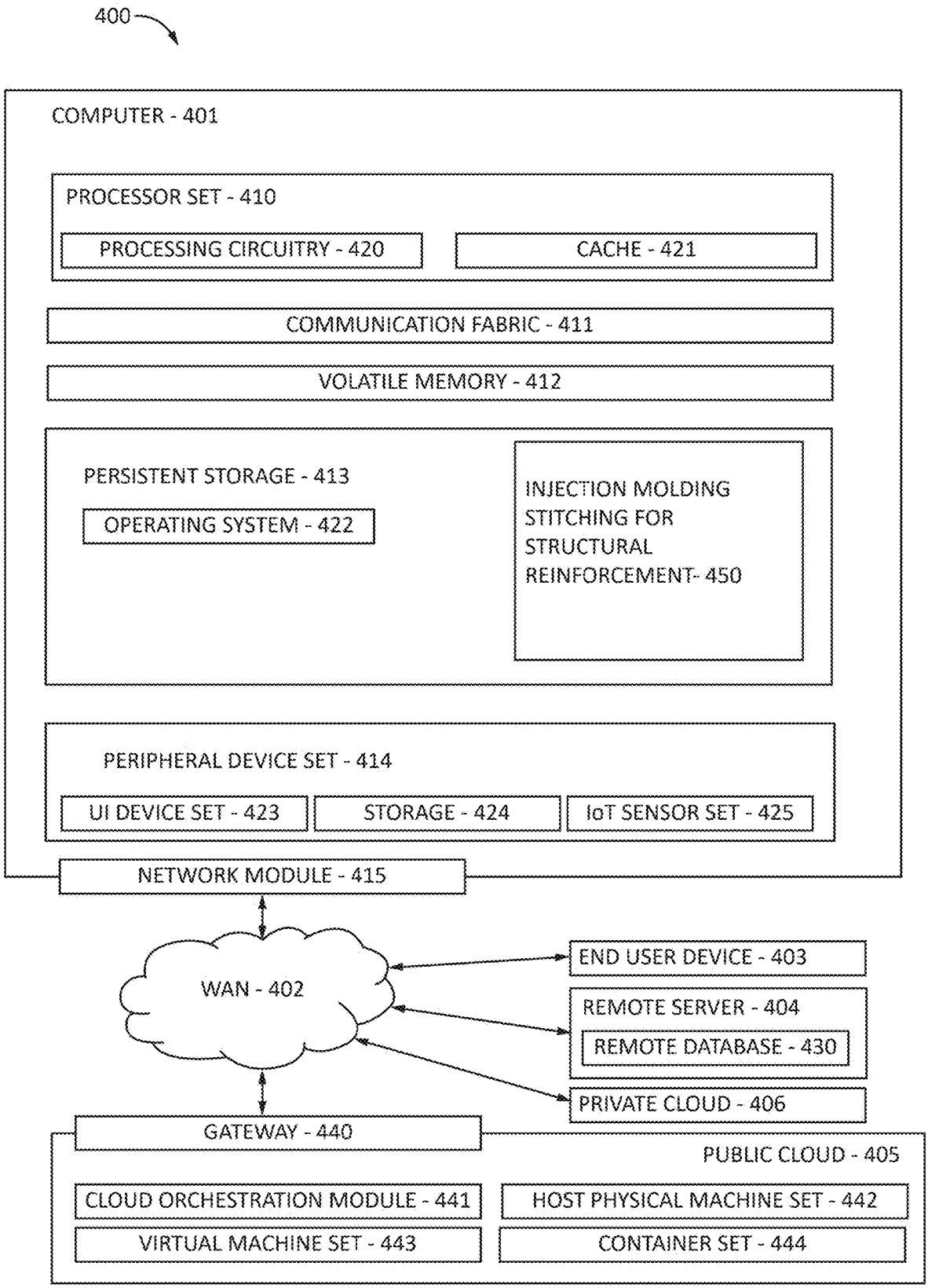
FIG. 8 is a block/flow diagram showing a computer system for making a repair of a structural element, in accordance with an embodiment of the present invention.

Referring to FIG. 8, a computing environment 400 contains an example of an environment for the execution of at least some of the computer code involved in performing the inventive methods, such as injection molding stitching for structural reinforcement 450. All or some of the functions performed in FIG. 1 can be performed in the computing environment 400. In addition to block 450, computing environment 400 includes, for example, computer 401, wide area network (WAN) 402, end user device (EUD) 403, remote server 404, public cloud 405, and private cloud 406. In this embodiment, computer 401 includes processor set 410 (including processing circuitry 420 and cache 421), communication fabric 411, volatile memory 412, persistent storage 413 (including operating system 422 and block 450, as identified above), peripheral device set 414 (including user interface (UI) device set 423, storage 424, and Internet of Things (IOT) sensor set 425), and network module 415. Remote server 404 includes remote database 430. Public cloud 405 includes gateway 440, cloud orchestration module 441, host physical machine set 442, virtual machine set 443, and container set 444.

COMPUTER 401 may take the form of a desktop computer, laptop computer, tablet computer, smart phone, smart watch or other wearable computer, mainframe computer, quantum computer or any other form of computer or mobile device now known or to be developed in the future that is capable of running a program, accessing a network or querying a database, such as remote database 430. As is well understood in the art of computer technology, and depending upon the technology, performance of a computer-implemented method may be distributed among multiple computers and/or between multiple locations. On the other hand, in this presentation of computing environment 400, detailed discussion is focused on a single computer, specifically computer 401, to keep the presentation as simple as possible. Computer 401 may be located in a cloud, even though it is not shown in a cloud in FIG. 8. On the other hand, computer 401 is not required to be in a cloud except to any extent as may be affirmatively indicated.

PROCESSOR SET 410 includes one, or more, computer processors of any type now known or to be developed in the future. Processing circuitry 420 may be distributed over multiple packages, for example, multiple, coordinated integrated circuit chips. Processing circuitry 420 may implement multiple processor threads and/or multiple processor cores. Cache 421 is memory that is located in the processor chip package(s) and is typically used for data or code that should be available for rapid access by the threads or cores running on processor set 410. Cache memories are typically organized into multiple levels depending upon relative proximity to the processing circuitry. Alternatively, some, or all, of the cache for the processor set may be located "off chip." In some computing environments, processor set 410 may be designed for working with qubits and performing quantum computing.

Computer readable program instructions are typically loaded onto computer 401 to cause a series of operational steps to be performed by processor set 410 of computer 401 and thereby effect a computer-implemented method, such that the instructions thus executed will instantiate the methods specified in flowcharts and/or narrative descriptions of computer-implemented methods included in this document (collectively referred to as "the inventive methods"). These computer readable program instructions are stored in various types of computer readable storage media, such as cache 421 and the other storage media discussed below. The program instructions, and associated data, are accessed by processor set 410 to control and direct performance of the inventive methods. In computing environment 400, at least some of the instructions for performing the inventive methods may be stored in block 450 in persistent storage 413.

COMMUNICATION FABRIC 411 is the signal conduction path that allows the various components of computer 401 to communicate with each other. Typically, this fabric is made of switches and electrically conductive paths, such as the switches and electrically conductive paths that make up buses, bridges, physical input/output ports and the like. Other types of signal communication paths may be used, such as fiber optic communication paths and/or wireless communication paths.

VOLATILE MEMORY 412 is any type of volatile memory now known or to be developed in the future. Examples include dynamic type random access memory (RAM) or static type RAM. Typically, volatile memory 412 is characterized by random access, but this is not required unless affirmatively indicated. In computer 401, the volatile memory 412 is located in a single package and is internal to computer 401, but, alternatively or additionally, the volatile memory may be distributed over multiple packages and/or located externally with respect to computer 401.

PERSISTENT STORAGE 413 is any form of non-volatile storage for computers that is now known or to be developed in the future. The non-volatility of this storage means that the stored data is maintained regardless of whether power is being supplied to computer 401 and/or directly to persistent storage 413. Persistent storage 413 may be a read only memory (ROM), but typically at least a portion of the persistent storage allows writing of data, deletion of data and re-writing of data. Some familiar forms of persistent storage include magnetic disks and solid state storage devices. Operating system 422 may take several forms, such as various known proprietary operating systems or open source Portable Operating System Interface-type operating systems that employ a kernel. The code included in block 450 typically includes at least some of the computer code involved in performing the inventive methods.

PERIPHERAL DEVICE SET 414 includes the set of peripheral devices of computer 401. Data communication connections between the peripheral devices and the other components of computer 401 may be implemented in various ways, such as Bluetooth connections, Near-Field Communication (NFC) connections, connections made by cables (such as universal serial bus (USB) type cables), insertion-type connections (for example, secure digital (SD) card), connections made through local area communication networks and even connections made through wide area networks such as the internet. In various embodiments, UI device set 423 may include components such as a display screen, speaker, microphone, wearable devices (such as goggles and smart watches), keyboard, mouse, printer, touchpad, game controllers, and haptic devices. Storage 424 is external storage, such as an external hard drive, or insertable storage, such as an SD card. Storage 424 may be persistent and/or volatile. In some embodiments, storage 424 may take the form of a quantum computing storage device for storing data in the form of qubits. In embodiments where computer 401 is required to have a large amount of storage (for example, where computer 401 locally stores and manages a large database) then this storage may be provided by peripheral storage devices designed for storing very large amounts of data, such as a storage area network (SAN) that is shared by multiple, geographically distributed computers. IoT sensor set 425 is made up of sensors that can be used in Internet of Things applications. For example, one sensor may be a thermometer and another sensor may be a motion detector.

NETWORK MODULE 415 is the collection of computer software, hardware, and firmware that allows computer 601 to communicate with other computers through WAN 402. Network module 415 may include hardware, such as modems or Wi-Fi signal transceivers, software for packetizing and/or de-packetizing data for communication network transmission, and/or web browser software for communicating data over the internet. In some embodiments, network control functions and network forwarding functions of network module 415 are performed on the same physical hardware device. In other embodiments (for example, embodiments that utilize software-defined networking (SDN)), the control functions and the forwarding functions of network module 415 are performed on physically separate devices, such that the control functions manage several different network hardware devices. Computer readable program instructions for performing the inventive methods can typically be downloaded to computer 401 from an external computer or external storage device through a network adapter card or network interface included in network module 415. WAN 402 is any wide area network (for example, the internet) capable of communicating computer data over non-local distances by any technology for communicating computer data, now known or to be developed in the future. In some embodiments, the WAN 402 may be replaced and/or supplemented by local area networks (LANs) designed to communicate data between devices located in a local area, such as a Wi-Fi network. The WAN and/or LANs typically include computer hardware such as copper transmission cables, optical transmission fibers, wireless transmission, routers, firewalls, switches, gateway computers and edge servers.

END USER DEVICE (EUD) 403 is any computer system that is used and controlled by an end user (for example, a customer of an enterprise that operates computer 401), and may take any of the forms discussed above in connection with computer 401. EUD 403 typically receives helpful and useful data from the operations of computer 401. For example, in a hypothetical case where computer 401 is designed to provide a recommendation to an end user, this recommendation would typically be communicated from network module 415 of computer 401 through WAN 402 to EUD 403. In this way, EUD 403 can display, or otherwise present, the recommendation to an end user. In some embodiments, EUD 403 may be a client device, such as thin client, heavy client, mainframe computer, desktop computer and so on.

REMOTE SERVER 404 is any computer system that serves at least some data and/or functionality to computer 401. Remote server 404 may be controlled and used by the same entity that operates computer 401. Remote server 404 represents the machine(s) that collect and store helpful and useful data for use by other computers, such as computer 401. For example, in a hypothetical case where computer 401 is designed and programmed to provide a recommendation based on historical data, then this historical data may be provided to computer 401 from remote database 430 of remote server 404.

PUBLIC CLOUD 405 is any computer system available for use by multiple entities that provides on-demand availability of computer system resources and/or other computer capabilities, especially data storage (cloud storage) and computing power, without direct active management by the user. Cloud computing typically leverages sharing of resources to achieve coherence and economies of scale. The direct and active management of the computing resources of public cloud 405 is performed by the computer hardware and/or software of cloud orchestration module 441. The computing resources provided by public cloud 405 are typically implemented by virtual computing environments that run on various computers making up the computers of host physical machine set 442, which is the universe of physical computers in and/or available to public cloud 405. The virtual computing environments (VCEs) typically take the form of virtual machines from virtual machine set 443 and/or containers from container set 444.

It is understood that these VCEs may be stored as images and may be transferred among and between the various physical machine hosts, either as images or after instantiation of the VCE. Cloud orchestration module 441 manages the transfer and storage of images, deploys new instantiations of VCEs and manages active instantiations of VCE deployments. Gateway 440 is the collection of computer software, hardware, and firmware that allows public cloud 405 to communicate through WAN 402. Some further explanation of virtualized computing environments (VCEs) will now be provided. VCEs can be stored as "images." A new active instance of the VCE can be instantiated from the image. Two familiar types of VCEs are virtual machines and containers. A container is a VCE that uses operating-system-level virtualization. This refers to an operating system feature in which the kernel allows the existence of multiple isolated user-space instances, called containers. These isolated user-space instances typically behave as real computers from the point of view of programs running in them. A computer program running on an ordinary operating system can utilize all resources of that computer, such as connected devices, files and folders, network shares, CPU power, and quantifiable hardware capabilities. However, programs running inside a container can only use the contents of the container and devices assigned to the container, a feature which is known as containerization.

PRIVATE CLOUD 406 is similar to public cloud 405, except that the computing resources are only available for use by a single enterprise. While private cloud 406 is depicted as being in communication with WAN 402, in other embodiments a private cloud may be disconnected from the internet entirely and only accessible through a local/private network. A hybrid cloud is a composition of multiple clouds of different types (for example, private, community or public cloud types), often respectively implemented by different vendors. Each of the multiple clouds remains a separate and discrete entity, but the larger hybrid cloud architecture is bound together by standardized or proprietary technology that enables orchestration, management, and/or data/application portability between the multiple constituent clouds. In this embodiment, public cloud 405 and private cloud 406 are both part of a larger hybrid cloud.

Figure 9:
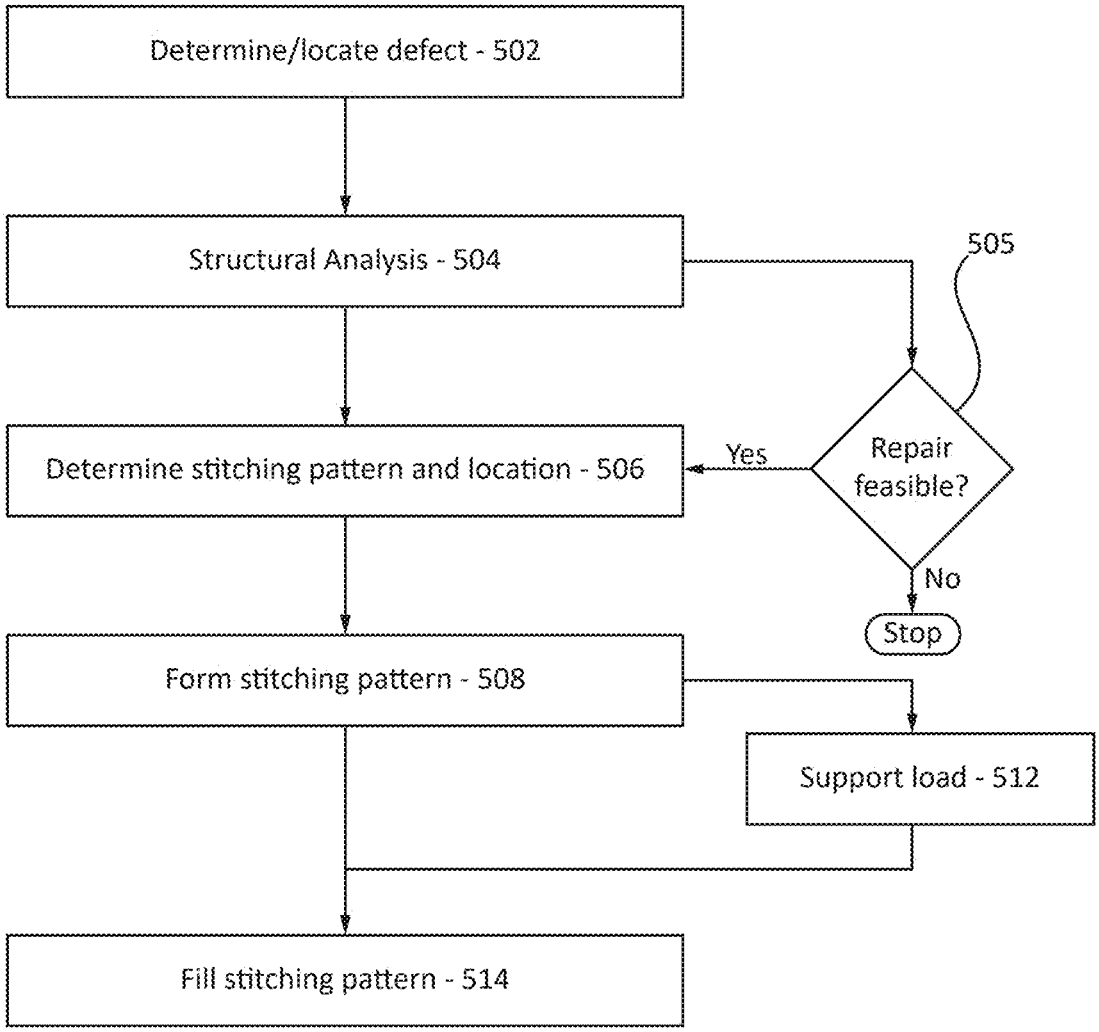
FIG. 9 is a flow diagram showing methods for stitching repairs for structural reinforcement, in accordance with an embodiment of the present invention.

Referring to FIG. 9, computer-implemented methods for repairing a structural defect are described and shown. In block 502, a size and position of a defect are determined within a structural element. This can include scanning the structural element using a penetrating energy source, such as ultrasound, x-rays, etc. In an embodiment, heat energy (infrared) can be measured to discover a defect. In block 504, a structural analysis can be performed to determine stress/strain within the structural element. The structural analysis can include finite element analysis or other computer aided design tools.

In block 505, a determination as to whether a repair is feasible can be made before proceeding with the repair. If the repair causes more damage than it fixes, the repair is not feasible. The feasibility of the repair can rely on other criteria as well. For example, the structural element is too small for the tools being employed, etc.

In accordance with the structural analysis of the defect, a stitching pattern that counters loss of structural integrity due to the defect can be determined in block 506. In block 508, a set of holes and channels can be formed in the structural element in accordance with the stitching pattern. This can include determining a number of stitches relative to a position of the defect, a diameter of the set of holes and channels, a pattern of the set of holes and channels (e.g., geometric patterns, such as a zig-zag pattern, diagonals, lines, etc.) and where, relative to the defect, the stitching pattern should be placed (e.g., on top, bottom sides, all of these and other configurations). The set of holes and channels can be formed in the structural element in accordance with the stitching pattern by employing, e.g., a robot milling tool that can be computer controlled. The robot milling tool can employ a 3D printing robot.

In block 512, the structural element can be supported during the forming of the set of holes and channels. This can include bypassing the load by using additional supports or removing the structural element from the load to do the repair.

In block 514, the set of holes and channels in the structural element are filled around the defect in accordance with the stitching pattern to increase strength around the defect. The filling of the set of holes and channels can include injection molding a material in the set of holes and channels, can include 3D/4D printing a material in the set of holes and channels, or another filling technique. Testing can be performed to test whether the repair is sufficient. This can include loading the structural element before putting it back in service.

As employed herein, the term "hardware processor subsystem" or "hardware processor" can refer to a processor, memory, software or combinations thereof that cooperate to perform one or more specific tasks. In useful embodiments, the hardware processor subsystem can include one or more data processing elements (e.g., logic circuits, processing circuits, instruction execution devices, etc.). The one or more data processing elements can be included in a central processing unit, a graphics processing unit, and/or a separate processor-or computing element-based controller (e.g., logic gates, etc.). The hardware processor subsystem can include one or more on-board memories (e.g., caches, dedicated memory arrays, read only memory, etc.). In some embodiments, the hardware processor subsystem can include one or more memories that can be on or off board or that can be dedicated for use by the hardware processor subsystem (e.g., ROM, RAM, basic input/output system (BIOS), etc.).

In some embodiments, the hardware processor subsystem can include and execute one or more software elements. The one or more software elements can include an operating system and/or one or more applications and/or specific code to achieve a specified result.

In other embodiments, the hardware processor subsystem can include dedicated, specialized circuitry that performs one or more electronic processing functions to achieve a specified result. Such circuitry can include one or more application-specific integrated circuits (ASICs), FPGAs, and/or PLAs.

These and other variations of a hardware processor subsystem are also contemplated in accordance with embodiments of the present invention.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Having described preferred embodiments (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

The invention claimed is:

1. A computer-implemented method for repairing a structural defect, comprising:

determining a size and position of an internal defect within a structural element;

in accordance with a structural analysis of the internal defect, determining a stitching pattern that counters loss of structural integrity due to the internal defect;

forming a set of through holes and channels within the structural element in accordance with the stitching pattern, wherein at least one of the set of through holes is directly connected to two other of the set of through holes via respective channels; and filling the set of through holes and channels in the structural element around the internal defect in accordance with the stitching pattern to increase strength around the internal defect.

2. The method of claim 1, wherein determining the size and position of the internal defect includes scanning the structural element using a penetrating energy source.

3. The method of claim 1, wherein determining the stitching pattern includes determining a number of stitches relative to a position of the internal defect and a diameter of the set of through holes and channels.

4. The method of claim 1, wherein forming the set of through holes and channels in the structural element in accordance with the stitching pattern includes employing a robot milling tool.

5. The method of claim 1, wherein filling the set of through holes and channels includes injection molding a material in the set of through holes and channels.

6. The method of claim 1, wherein filling the set of through holes and channels includes three dimensional printing a material in the set of through holes and channels.

7. The method of claim 1, further comprising supporting the structural element during forming of the set of through holes and channels.

8. The method of claim 1, further comprising determining whether a repair is feasible.

9. A system for repairing a structural defect, comprising:

a hardware processor; and a memory that stores a computer program which, when executed by the hardware processor, causes the hardware processor to:

determine a size and position of an internal defect within a structural element;

in accordance with a structural analysis of the internal defect, determine a stitching pattern that counters loss of structural integrity due to the internal defect;

form, with a computer controlled milling tool, a set of through holes and channels within the structural element in accordance with the stitching pattern, wherein at least one of the set of through holes is directly connected to two other of the set of through holes via respective channels; and fill, with a computer controlled filling tool, the set of through holes and channels in the structural element around the internal defect in accordance with the stitching pattern to increase strength around the internal defect.

10. The system of claim 9, wherein the size and position of the internal defect are determined using a penetrating energy source on the structural element.

11. The system of claim 9, wherein the stitching pattern includes a number of stitches relative to a position of the internal defect and a diameter of the set of through holes and channels.

12. The system of claim 9, wherein the computer controlled milling tool includes a robot milling tool.

13. The system of claim 9, wherein the computer controlled filling tool includes an injection molding device.

14. The system of claim 9, wherein the computer controlled filling tool includes a three dimensional printer.

* * * * *